United States Patent [19]

Dokoupil et al.

[11] Patent Number: 4,856,201

[45] Date of Patent: Aug. 15, 1989

[54] SYSTEM FOR CONDITIONING OF LEATHER HIDES, FURS AND THE LIKE

[76] Inventors: Jiri Dokoupil, Hochstrasse 9, D-6254 Gückingen; Thaddaeus Kuzzora, Schoenbornerstrasse 8, D-6251 Flacht, both of Fed. Rep. of Germany

[21] Appl. No.: 13,737

[22] Filed: Feb. 12, 1987

[30] Foreign Application Priority Data

Jun. 12, 1985 [DE] Fed. Rep. of Germany ..... 3521061

[51] Int. Cl.[4] ..... F26B 3/34

[52] U.S. Cl. ..... 34/1; 34/46; 34/151

[58] Field of Search ..... 34/46, 151, 1, 48; 219/10.55 R, 10.55 M

[56] References Cited

U.S. PATENT DOCUMENTS

| | | | |
|---|---|---|---|
| 3,731,520 | 5/1973 | Hickman et al. | 34/48 |
| 3,775,860 | 12/1973 | Barnes et al. | 34/1 |
| 4,405,850 | 9/1983 | Edgar | 34/1 |
| 4,438,570 | 3/1984 | Dokoupil | 34/1 |
| 4,468,865 | 9/1984 | Inagaki | 34/1 |
| 4,487,041 | 12/1984 | de Bourg | 69/1 |
| 4,616,425 | 10/1986 | Burns | 34/89 |

FOREIGN PATENT DOCUMENTS

| | | | |
|---|---|---|---|
| 8517168 | 3/1986 | German Democratic Rep. | 34/1 |
| 2073241 | 10/1981 | United Kingdom | 34/1 |

*Primary Examiner*—Henry A. Bennet

*Attorney, Agent, or Firm*—Horst M. Kasper

[57] ABSTRACT

The present invention provides a system for the drying of leather where an improved uniform distribution of the desired residual moisture content is obtained and a reproducible setting of the moisture content is effected in a capable and powerful method. The leather is subjected to an absorption heating with an electromagnetic wave field in a frequency region of from 0.3 to about 30 GHz. During or alternating with this application, the material to be treated is subjected to a treatment pressure lower than atmospheric pressure. The application of the microwave absorption device in connection with lowered pressure results in the required and desired properties of the leather with respect to residual moisture content. Furthermore, an improvement of the flexibility and handling capabilities of the leather results because of the generation of heat inside of the leather.

47 Claims, 5 Drawing Sheets

SYSTEM FOR CONDITIONING OF LEATHER HIDES, FURS AND THE LIKE

BACKGROUND OF THE INVENTION

1. Field of the Invention

The invention relates to a method for thermal treatment and in particular to conditioning, drying, and/or humidifying of leather hides, furs, and the like. The invention relates further to a device for the performance of such method.

2. Brief Description of the Background of the Invention Including Prior Art

In tanning and leather processing, conditioning is considered generally as the adjustment of certain desired properties of leather or, respectively, skins, hides, and furs by controlled interaction with environmental conditions such as temperature, humidity, and pressure of the air, gas or vapor atmosphere contacting the material to be treated. Furthermore, the application of energy radiation is included in such conditioning. In particular, the deformation properties such as flexibility, extensive tensioning properties and the like and of surface properties of the materials as well as further material properties important for the processing are dependent on the moisture content. A change in the moisture content and quicker evaporation processes within the porous material can also have immediately desired influences on the recited material properties. This also concerns the thermal treatment of the material as such in addition to the indirect effect of the drying. The application of energy containing radiation, such as infrared radiation in general serves as a means for heating but under circumstances it can also exert an influence on certain material properties.

The conventional processes for conditioning of the recited materials are limited substantially to drying by heating with thermal convection or infrared radiation possibly with a forced motion of the surrounding air for removal of the air humidity generated by evaporation from the material. This process method requires improvement with regard to effectiveness and in particular to the adjustibility of the desired material properties and of the amount of material processed in such equipment. The same thing holds true for the corresponding apparatus.

SUMMARY OF THE INVENTION

1. Purposes of the Invention

It is an object of the present invention to provide a method that is more effective and that is more reproducible in the setting of the properties of the treated material or, respectively, that improves the efficiency versus conventional annual skin product treatment methods.

It is a further object of the invention to provide a apparatus that is adapted to provide a controlled processing of animal skin products.

It is yet a further object of the invention to provide for an easily reproducible and quickly achievable moisture content adjustment of animal skin products.

These and other objects and advantages of the present invention will become evident from the description which follows.

2. Brief Description of the Invention

The present invention provides a method for thermal treatment for animal skin products comprising subjecting an animal skin product to a pressure below atmospheric pressure, and applying an electromagnetic alternating wave field of a frequency from about 0.3 GHz to 30 GHz to the animal skin product in order to dry the animal skin product. The animal skin product can be a member of the group consisting of leather, hide, fur and composites thereof.

The pressure below atmospheric pressure is preferably below 0.7 bar, and the value of the pressure below atmospheric pressure corresponds to a temperature of up to about 70 degrees centigrade corresponding to a boiling point of water at the respective temperature for evaporating water contained in the animal skin product. More preferably, the pressure below atmospheric pressure is below 0.5 bar, and the value of the pressure below atmospheric pressure corresponds to a temperature of up to about 50 degrees centigrade corresponding to a boiling point of water at the respective temperature for evaporating the water contained in the animal skin product. The boiling point of the water is referred to above. The pressure applied is a pressure lower than atmospheric and has to adapted to correspond to the desired boiling point of the water. There is a relationship between the temperature of the boiling point of the water and the pressure applied. The material treated can contain from about 0 to 99 percent water.

The animal skin product can be subjected to electromagnetic waves of a frequency region of from about 1.2 to 2.8 GHz in the case of lighter animal skin products. Heavier animal skin products preferably are subjected to electromagnetic waves of a frequency region of from about 18 to 30 GHz. The material to be treated can be of an arbitrary geometrical shape.

The subject of the material to be treated to pressures below atmospheric pressure can alternate with the application of an electromagnetic wave field or can be carried out simultaneously with application of an electromagnetic field.

Water can be applied in fluid form to the animal skin product. The temperature of the water can reach up to 100 degrees centigrade and the water pressure can be from about 0.5 to 10 bars. The water can be applied to the animal skin product in conjunction with the thermal treatment.

An actual value for a moisture content of the animal skin product can be determined, and the determined actual value can be compared with a preset set point value. The application of the electromagnetic alternating wave field can be interrupted if the determined actual value reaches the set point value.

An electromagnetic alternating wave field of a frequency of from about 0.3 to 30 GHz can be employed, and the actual value of the moisture content of the animal skin product can be intermittently determined. A cycle can last from about 1 to 100 seconds and preferably lasts from about 5 to 30 seconds.

A plurality of measurement sensors can be distributed over a piece of animal skin product for determining an actual value of a moisture content of the animal skin product. The geometry of the distribution can correspond to the geometrical shape of the animal skin product and, in particular, of a piece of leather. The measurement sensors are commercially available from the Dynavac Co. These sensors can operate on a resistive or on a capacitive principle. A statistical value determination of the actual moisture content values associated with the different measurement locations can be made.

The average values and calculated values can be determined by automatic calculation with a microprocessor.

Another aspect of the present invention provides an apparatus for thermal treatment of animal skin products comprising at least one treatment chamber for receiving and operating on animal skin products. An electrical microwave heating device is disposed at the chamber for heating animal skin products placed in the chamber. In general, the electrical microwave device generates an inhomogeneous electromagnetic field in the chamber and which inhomogeneous electromagnetic field in turn generates an inhomogeneous temperature field in the chamber. The inhomogeneous temperature field referred to above means that temperature differences exist between different spacial locations within the chamber which are larger than ±20 degrees centigrade. The periods of the field can have a core shaped structure. Therefore a movable support is provided for the animal skin product such that the animal skin product can be moved through at least part of the inhomogeneous electromagnetic field in a way balances the inhomogenities and provides for a more uniform heating. The support is moved by a drive is connected to it. The speed of motion can be between 1 and 100 centimeters per second.

The electromagnetic heating device can be subdivided into sections, and a control device can be connected to the seconds to activate various sections sequentially. The electromagnetic heating device can comprise microwave generators or, respectively, controllable microwave coupling devices placed in a spatial distribution where the microwave generators or, respectively, controllable microwave coupling devices can be activated according to a predetermined sequence. This arrangement is provided in order to obtain an improved energy distribution. There can be provided feed means for animal skin products in the wall of the chamber, where the feed direction of the animal skin product can be oriented substantially crosswise to an entry coupling direction of the microwave energy field generated in the chamber by the electromagnetic heating device A grid like arrangement of microwave feeding devices can be disposed in a wall of the chamber to generate an energy field with a predetermined maximum inhomogeneity in the treatment chamber. The grid can include a disposition of multiple corner grid elements with a microwave feeding device disposed in the region of a corner. The microwave feeding devices disposed at corners of grid elements can be modulated with a phase shift corresponding about to their geometrical angle at the circumference of the multiple corner grid elements. The periods can be in the range of from about $10^{-3}$ to 1 per second and are preferably between $10^{-2}$ to $10^{-1}$ per second.

The electromagnetic microwave device can include a plurality of microwave power feeding devices in a wall of the chamber, where the microwave power feeding devices are disposed with their radiation output ports substantially immediately at a chamber wall bordering the treatment chamber.

A measurement sensor for humidity can be disposed alternatingly at a sensing location touching the leather and at a rest position located remote from the animal skin product. A multiple measurement sensing device with a plurality of sensors active over the surface of the animal skin product or, respectively, with a sensor adjustable in its position over the animal skin product for scanning over the surface of the animal skin product can be employed for determining the animal skin product moisture content.

A construction unit can provide a support device that is movable out of its working position within a chamber forming the treatment space through a section of a wall of the chamber, which during working conditions is substantially closed. The support device can include a front wall, a side wall, and a floor section of the chamber wall formed as a support element of the support device, and can include a support means disposed at the front wall and the side wall and formed as horizontal support elements for the animal skin product. The support device can include drive works disposed at the floor section and can be formed as a movable construction unit, which can be moved independently of the treatment chamber in an outward moved state relative to the treatment chamber.

A support device with support means for animal skin products can be provided where the support means at least in the region of their touch points with the animal skin product are composed of a material low in absorption of microwave radiation. The support means can be provided with moisture content sensors in the area supporting the animal skin product.

The treatment chamber can be provided with a feed opening for the animal skin product and with closure means for sealing substantially without gaps the feed opening in the treatment space against emission of microwave radiation and for preventing a gas exchange between the treatment chamber and the outside. The closure can include a tube shaped envelope unit with a filling of an absorbing fluid medium. A substantially gapless detection unit can be provided to detect a leakage of microwave radiation.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENTS

Figure 1:
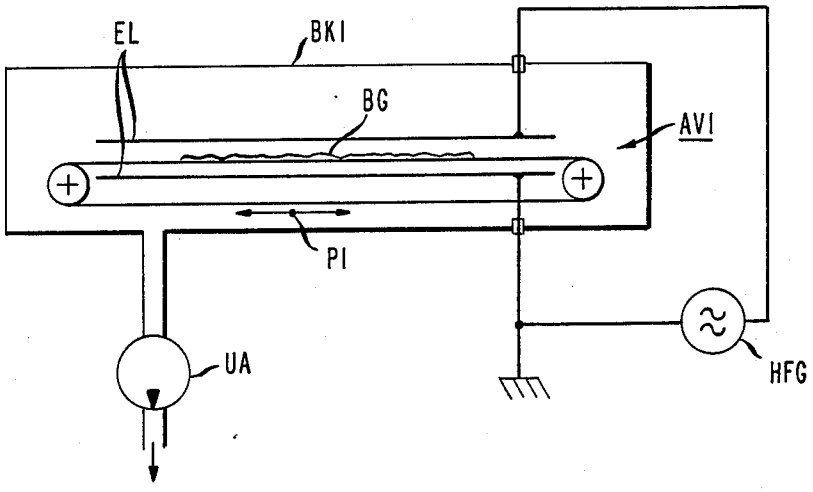
FIG. 1 is a schematic vertical section with a block circuit diagram of a first embodiment of a drying apparatus for the invention method.

The present invention provides a method for the thermal treatment and in particular for conditioning, drying, and moisturizing of leather hides, furs, skin pelt jackets, rawhide, sheepskin, patent leather, shoe leather, suede, tawed leather, white leather, hat leather, cup leather, calfskin, fleece, goatskin, boar's hide, lambskin, mink, rabbit, wool, and the like. The material to be treated is subjected to an electromagnetic wave field in a frequency region from about 0.3 GHz to about 30 GHz in order to provide for heating by absorption of the electromagnetic radiation. The material is subjected simultaneously or alternatingly to a treatment pressure that is lower than atmospheric pressure.

The treatment pressure can be 0.7 bar or less, preferably less than 0.6 bar and more preferably less than 0.5 bar. The material to be treated simultaneously or, respectively, alternatingly with heat and with decreased pressure can be subjected to a decreased pressure corresponding to an evaporation temperature of the water contained in the material to be treated of at most 70 degrees centigrade and preferably at most 50 degrees centigrade.

The material can preferably be treated with electromagnetic waves in a frequency region of from about 1.2 GHz to about 2.8 GHz. The material can be treated alternatively with electromagnetic waves in a frequency region of about 18 GHz to about 30 GHz. A thermal treatment can be provided accompanied by an application to the material to be treated of water vapor and/or water and preferably of water and/or water vapor in the form of a fine mist. Such water or water vapor treatment can occur simultaneously or, respectively, alternatingly with the thermal treatment.

The electromagnetic wave field preferably can be in a frequency region of 0.3 to about 30 GHz. During the drying process the actual value of the moisture content of the leather can be determined and can be compared with a preset set point value. The drying can be terminated depending on the reaching of the set point. Furthermore, the actual value of the moisture content of the leather can be determined intermittently. The actual value of the leather moisture content in addition can be determined at a plurality of measurement sensors distributed over at least one leather piece. The actual values of the moisture content coordinated to the various measurement sensors can be subjected to statistical interpretation including for example the formation of average values, of extreme values and other median values.

The is also provided a device for the thermal treatment and in particular the conditioning, the drying and/or the moisturizing of leather skins, furs and the like with at least one treatment space for receiving the material to be treated and at least one electrical heating device. This apparatus is particularly suited for performing the invention method set forth above. There is provided an electrical microwave heating device that generates in the treatment space an inhomogeneous and in particular at least approximately spacially periodically distributed temperature field. A movable disposed support device for the material to be treated is connected to a motion drive, which preferably can effect a rotary motion. At least part of the inhomogeneous temperature field is passed by the path of the motion of the material to be treated.

An electrical microwave heating device that generates in the treatment space an inhomogeneous and in particular at least approximately spacially periodically distributed energy field. A control device can be provided that is effectively coupled with the heating device and that activates various microwave field regions in a predetermined sequence, which is preferably a periodic sequence.

The microwave heating device can include a plurality of microwave generators and/or a plurality of controllable or switchable microwave coupling devices that are in a power transmitting connection with the treatment space and that are spacially distributed. The generators or, respectively, the coupling devices can be activated with the control provision in a predetermined sequence.

An electrical microwave heating device can be provided that generates an energy field in the treatment space, and the microwave energy field can at least in part be radiated into or coupled into the treatment space from at least two wall regions disposed oppositely to each other. The treatment space can be formed by a chamber with a feed opening, and the chamber wall section having this feed opening or, respectively, the feed direction can be disposed substantially crosswise to the irradiating or, respectively, coupling direction of the microwave energy field, which is diametrically disposed relative to the treatment space.

An electrical microwave heating device with at least a grid shape spacially distributed arrangement of emitters or coupling devices can be provided for generating an energy field of presettable maximum inhomogeneity in the treatment space. At least one of the grid emitters or coupling devices distributed around the multiple cornered circumference can be modulated at at least part of the grid elements with a phase shift corresponding to their mutual angle staggering at the multicorner circumference and in particular the emitters or, respectively, coupling devices can be activated and deactivated periodically. The emitters with their radiation outputs can be connected substantially immediately at the chamber wall confining the treatment space. At least a moisture measurement sensor can be provided disposed between a measurement location touching the leather and a rest position with from the leather. A multiple measurement device can be provided having a plurality of measurement sensors distributed and becoming active over a leather surface and/or with at least one measurement sensor adjustable between various measurement locations at the leather.

The treatment space can be formed as a chamber that is substantially closed during operating conditions. A support device can be formed with at least one section of the chamber wall as a construction unit that can be moved out of a working position disposed within the chamber. The support device can comprise at least one front and/or a side wall section as well as at least one floor section of the chamber wall formed as a support element of the support device. A support means can be disposed at the front or, respectively, the side wall section of the support device. In particular, these support means can have the shape of horizontally disposed rods, plates, grids or other forms suitable for supporting the material to be treated. The support device can be provided with a drive works disposed at the floor section. The drive device can be formed as a construction unit movable independently from the treatment chamber when it has been moved out from the treatment chamber within the support device.

An electrical microwave heating device can be provided for generating an energy field in the treatment space. A support device for the material to be treated can be provided with supports for leather pieces or the like. These supports can be comprised, at least in the region of the locations of contact with the material to be treated, of a material having low absorption of microwaves. The support can be provided with moisture measurement sensors in the area where the leather to be treated is positioned.

An electrical microwave heating device can be provided to generate an energy field in the treatment space, and a feed opening and/or a closure can be furnished with an at least approximately gapless sealing against an exit of microwaves and possible against entering and exiting of air or treatment medium.

An electrical microwave heating device can be provided that generates an energy field in the treatment space, and a feed opening and/or a closure with an at least approximately gapless detection device can be provided to observe and safeguard against an exit of microwaves. The microwave sealing or, respectively, the microwave detection device can exhibit at least one preferably tube shaped enveloping element with a filling of a medium that can absorb microwaves. This medium can be in particular a liquid.

Referring now to FIG. 1, there is shown a chamber BK1 with a connection to a low pressure plant unit UA. The treatment chamber BK1 is stable and sealed against decreased pressure. The support device AVl for leather hides, furs, or the like designated as treatment material BG is formed as a circulating transport belt disposed in the chamber. The material to be treated BG is disposed on the upper side of the transport belt and is disposed in an electromagnetic alternating field, which is disposed between the large area face plate electrodes EL. The electrodes EL are connected to a high frequency powered generator HFG, which operates in the frequency region between about 10 and 300 MHz. A relatively intense low pressure is generated in the chamber BK1 during the drying process, that is, during the heating of the material to be treated by the dielectric losses in the high frequency field, or also advantageously in alternation with successive period of switching on the field. The relatively intensive low pressure is not only sufficient for sucking up the generated water vapor but also substantially decreases the evaporation temperature of the water contained in the leather or the like preferably to at most about 70 degrees centigrade. It is particularly effective with respect to an additional flexibilization of the leather by cellular explosion effect during the water evaporation. However, it is furthermore useful in particular up to about 50 degrees centigrade and below. In particular, a chamber pressure of 0.7 bar to about 0.6 bar for the lighter and porous leather materials has been shown to be advantageous for the conditioning of leather that includes in particular lighter and more porous leather kinds such as hides and furs with large specific surface. A chamber pressure of from about 0.5 bar to 0.6 bar and below has been found to be advantageous for heavier kinds of leather. According to experience, the lower pressures favor the flexibilization to a large extent. The relatively low treatment temperature acts to improve the uniformity of the drying process and favors an exact guiding of the method with reproducible termination of the drying process, which guards against going below the optimum moisture content values of the leather and thereby making it brittle.

A further essential property of the apparatus according to FIG. 1 is the possibility to achieve an oscillating motion of the material to be treated within the high frequency field by a periodic reversal of direction according to arrow P1 of the transport belt drive not shown in FIG. 1. An advantageous balancing of the inhomogeneities of the high frequency field, which cannot be excluded completely in practical applications, results. Thus a substantially uniform heating of all regions of the material to be treated can be achieved.

Figure 2:
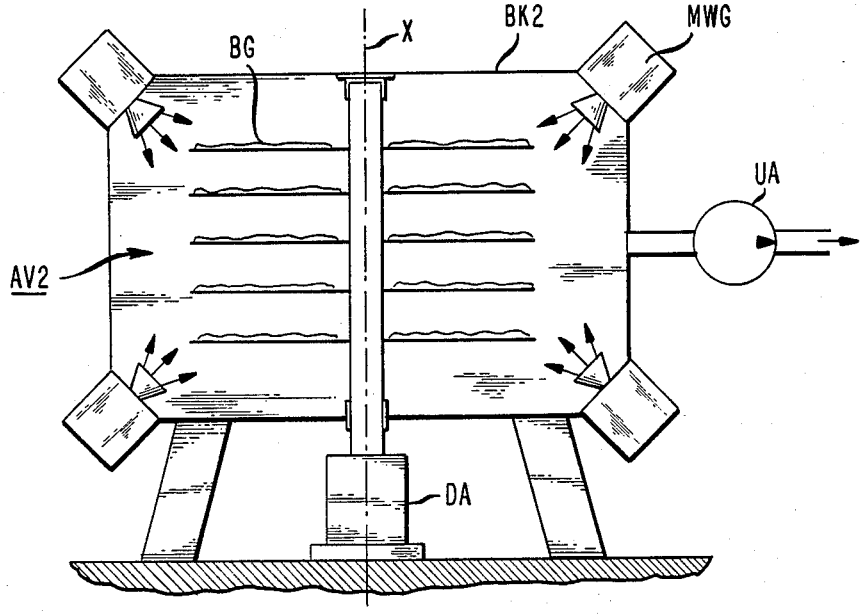
FIG. 2 shows an illustration corresponding to FIG. 1 for a second embodiment of a drying apparatus with an illustration of a further method of according to the invention for the conditioning of leather and the like, FIG. 3 shows a schematical horizontal section with a block circuit diagram with a third embodiment of an invention apparatus for conditioning of leather and the like, FIG. 4 is a view of a schematic vertical section of an invention treatment apparatus with a movable support device for the material to be treated.

The embodiment according to FIG. 2 is characterized by a novel combination of the application of microwaves with a low pressure application onto the leather and the like for achieving drying or, respectively, conditioning and flexibilization. Microwave generators MWG are provided and distributed in the treatment chamber BK2. The superposed fields of the distributed microwave generators MWG are applied to the material BG disposed in a plate support device AV2. The heating is achieved substantially by absorption of microwaves in the water containing regions such as pores and cells of the material. The advancing drying with decreasing water content automatically brakes the speed of the drying process. This advantageously decreases a danger of an overdrying and overheating of the leather in particular in connection with the already mentioned effects of the low pressure application to the material to be treated. It has further been found that the cooperation of the microwave heating and a relatively strong low pressure given substantially improved results as compared with those of high frequency heating.

A frequency region for the microwaves of from about 0.3 to 30 GHz is to be considered in principle for the drying and conditioning of leather hides. However, for lighter leather kinds and furs, a frequency of from about 0.2 to 2.8 GHz has been shown to be particularly advantageous. For heavier materials, frequencies from 18 to 30 GHz have proven to advantageous.

The microwave fields and their reflections are superposed on each other within the treatment space giving in general a resulting energy field of still substantial inhomogeneity. In order to achieve a balancing, the support device AV2 for the material to be treated is formed rotatable around a vertical axis X and a corresponding rotary drive BA is provided such that the path of motion of the material to be treated passes through the inhomogeneous parts of the energy field.

Figure 3:
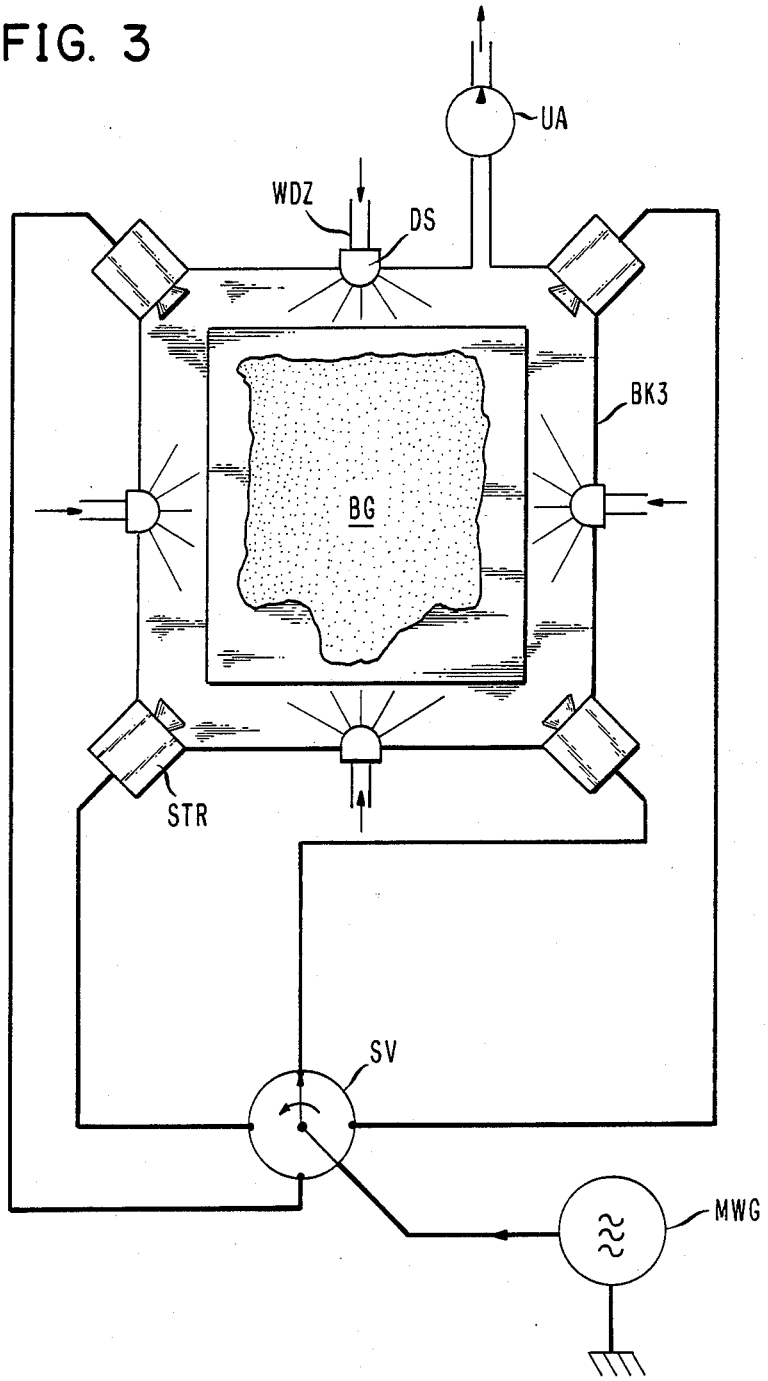

According to the embodiment of FIG. 3, microwave coupling devices or, respectively, microwave feeding devices STR are distributed at a treatment chamber BK3. The microwave coupling devices or, respectively, the microwave irradiating devices are connected in a predetermined sequence to a microwave power generator MWG via a periodically operating switch SV. The microwave coupling devices or microwave radiation devices STR are thus activated. Possibly a corresponding mechanical coupling valve switching in connection with waveguides or, respectively, at the irradiators can be applied in analogy to the switching schematically indicated by way of example. Furthermore, successive switching on or, respectively, activation of a plurality of generators can be employed, which needs no further elaboration.

Feeds WD2 with distributing nozzles DS for finely dispersed water or vapor are disposed at the treatment chamber according to FIG. 3, which also shows a low pressure plane UA. This allows moisturization or back moisturization of the material to be treated in connection with a change in the drying process. This is not only an advantage for the setting of accurate moisture content values but also for special alternating effects.

Figure 4:
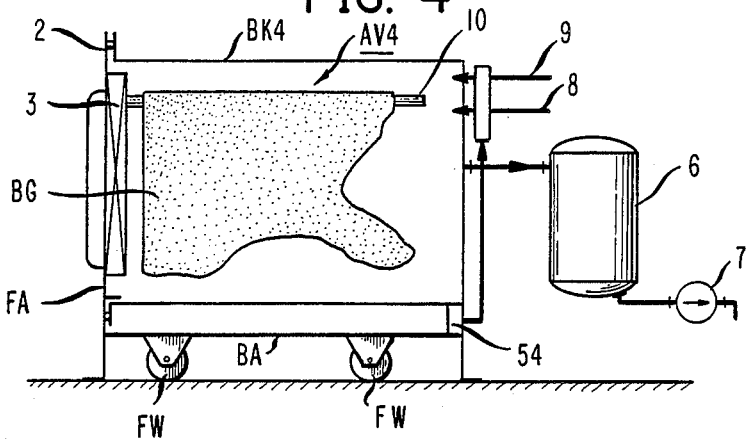

The treatment chamber BK4 with a support device AV4, which can be moved in and out of the chamber, is provided according to the embodiment of FIG. 4. The support device AV4 is formed as a construction unit with the front wall section FA and a floor section BA of the chamber as support elements. FIG. 4 illustrates the construction unit provided with a drive works FW. The construction unit, which can be moved independently of the chamber when it has been moved out of the chamber, is illustrated in FIG. 4 in position during operation within the chamber.

Figure 6:
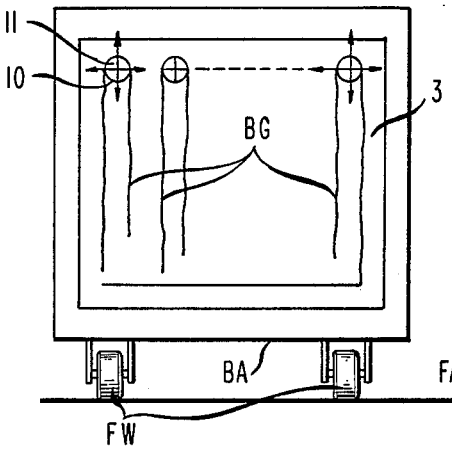
FIG. 6 is a vertical section of the support device illustrated in FIG. 1 under rotated vertical section.
Figure 5:
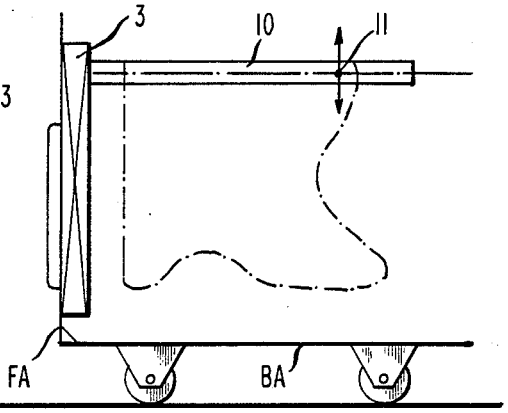
FIG. 5 is a sectional view of the support device for the material to be treated according to FIG. 4.

A gapless sealing allows application of low pressure with in the chamber. The planned low pressure is to be achieved with boiler 6 and pumps 7. The connections 8 or, respectively 9 are provided for the moisturization with water ore, respectively, water vapor. In addition heating and drying air can be fed in via a connection 3 and, for example, the support elements 10 of the support device AV4 can be provided for example as tubes with exit openings 11. The material to be treated BG hangs on the support device AV4 (Compare FIG. 6). A switch 54, which is automatically activated during moving of the support device into the chamber effects the switching of the heat energy providing microwaves, which are not here shown in detail. It is important for work safety to provide such a mechanism.

Figure 8:
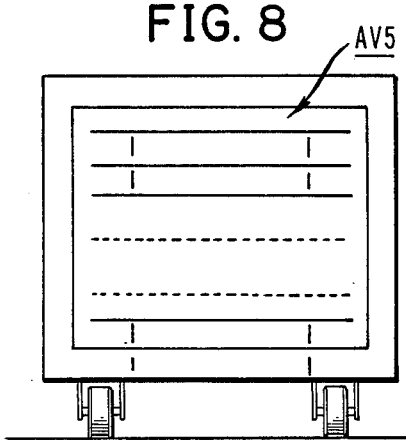
FIG. 8 is a view of a vertical section rotated 90 degrees of the support device of FIG. 7.
Figure 7:
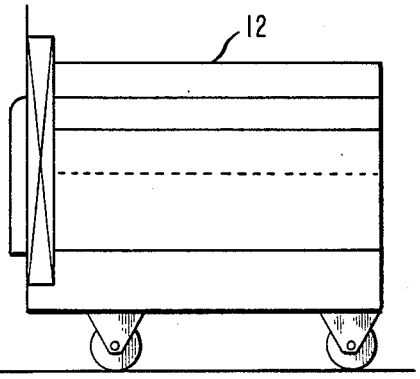
FIG. 7 is a view of a section according to FIG. 5 for a further embodiment of a support device for treatment of material.

FIG. 8 and 7 illustrate a similar support device AV5 with horizontal plate elements 12 as support for leather and the like.

Movable support devices of the kind illustrated can be formed simply, with great strength and easily moved into the chamber with a good fit because of the employment of chamber wall elements. In particular, a suitable number of it each case movable support devices disposed in a chamber allows a economical and favorable battery drive.

Figure 9:
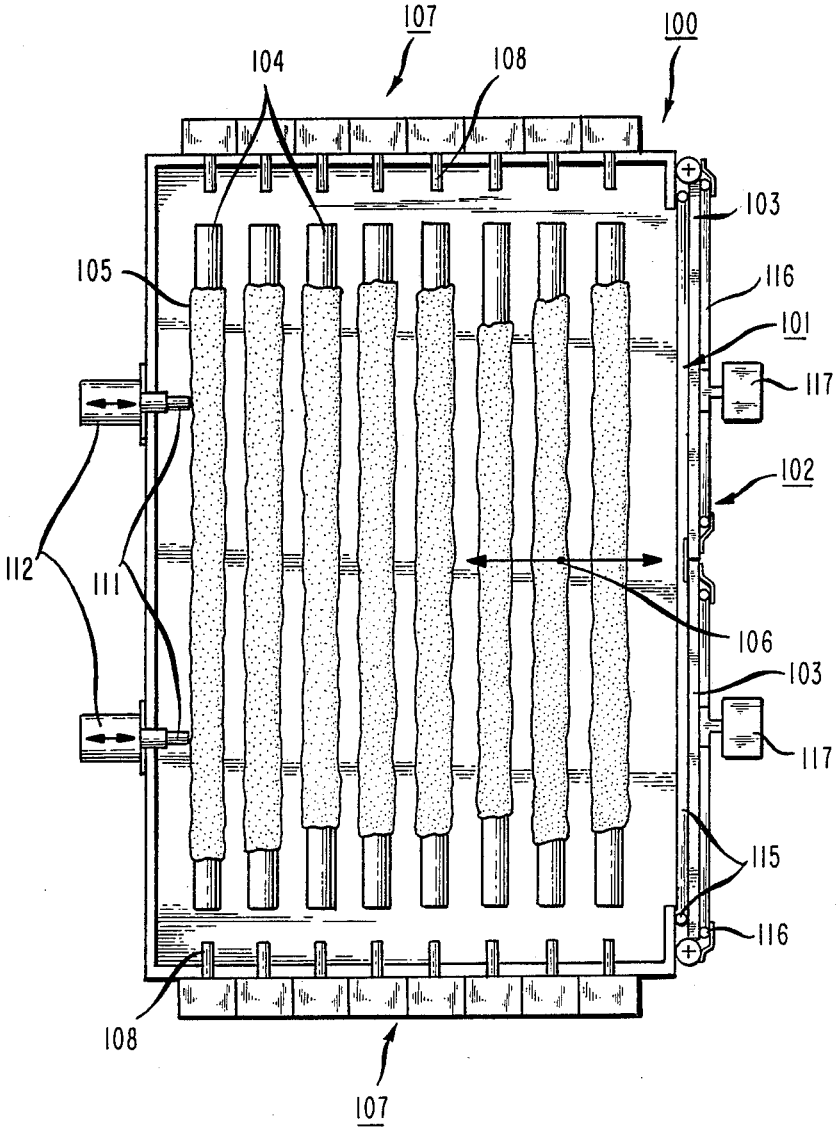
FIG. 9 is a plan view of a horizontal section of a further embodiment of a treatment chamber with microwave heating.

The treatment chamber 100 illustrated in FIG. 9 is furnished with a feed opening 101 extending substantially over the full front side. The feed opening 101 can be closed by a two wing door 102. The charge, that is, the loading and deloading of the leather pieces 105 hanging on a rod shaped supports 104 is performed in the direction of the arrow 106. the supports 104 are for this purpose united with support and guide elements to form a movable support device not shown in detail here, but illustrated by way of example in the above described embodiments. Multiple microwave emitter arrangements 107 are provided at the two side walls of the chamber, and the multiple microwave emitter arrangement 107 has a main irradiation direction crosswise to the feeding direction according to arrow 106. This diametrical arrangement of the emitters favors the desired nearly homogeneous distribution of the energy or, respectively, of the absorption generated temperature field in the chamber. The irradiating members 108 of the microwaves emitters run immediately into the treatment space, that is, without intermediately disposed coupling members, which results not only in a comparatively simple and production favorable construction but which in particular makes the setting of pre-set field distributions in the chamber. A particular effect in this context is the applied surface grid shaped distribution of the irradiating members 108 with in the chamber side walls. As detailed measurements and investigations of different arrangements have proved, the possibility of an optimum approach to the desired homogeneous field distribution is achieved.

Figure 10:
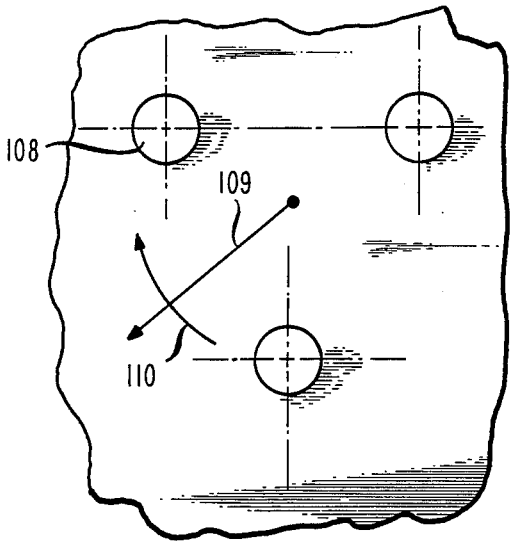
FIG. 10 is a view of a section of a side wall of the treatment chamber according to FIG. 9 with a triangular microwave emitter arrangement.

A grid face element with triangularly disposed irradiating members 108 is shown in FIG. 10 as a section of such a multiple microwave emitter arrangement. Because of the superposition of the electric and magnetic field components, there results a particular further embodiment of the invention according to which the emitters or, respectively, irradiating members are controlled or synchronized with a phase shift corresponding to their angular staggering at the circumference of the grid element. According to the example the emitters or, respectively irradiating members are uniformly distributed and thus would be controlled to provide a uniform phase shift or synchronization. A resulting field vector 109 is formed that circulates as a field vector rotating for example in the direction 110. In particular, a lower frequency modulation or scanning of the emitters with a corresponding phase shift also can be employed. In any case, a synchronization of the emitters is required. The circulating field vector effects a desired agreement of the absorption and heat generation in particular by providing a compensation for spacial inhomogeneities already present in the absorption capacity of the material to be treated.

The apparatus according to FIG. 9 is intended for a drying operation with a continuous measurement of humidity at the leather pieces 105. Humidity measurement sensors 111 disposed in the back wall of the chamber serve this purpose. The humidity measurement sensors 111 can be adjusted between one measurement position where the rearmost leather piece is touched and a rest position where there is no touching of the leather. This adjustment is accomplished by way of double acting set cylinders 112 controllable in predetermined intervals. This mode of operation and the corresponding measurement arrangement result in the advantage that the electrically conducting and therefore wave absorbing measurement sensor tips in each case contact only the leather for a short time and therefore locally concentrated heating of the leather with the corresponding increased drying can be kept very low. At the same time the arrangement allows a continuous monitoring of the moisture content in the leather and thus a determination of the drying upon reaching of the desired residual moisture content, that is, of the moisture content set point value. Such a mode of operation has until now not been possible. Therefore a expansive remoisturization of the leather had to be employed in conventional apparatus. In addition the arrangement of several measurement sensors distributed over the surface of the leather also allows a control of the spacial uniformity of the moisture content in the leather. For this purpose, the number of the measurement sensors with corresponding setting and control devices of a kind known in principle can be increased substantially versus the example shown. Advantageously, formation of an average value can be employed for evaluation of the multiple measurement in order to represent the overall drying process. An extreme value determination can also be made for controlling a possibly too large spacial inhomogeneity in the leather moisture content.

Figure 11:
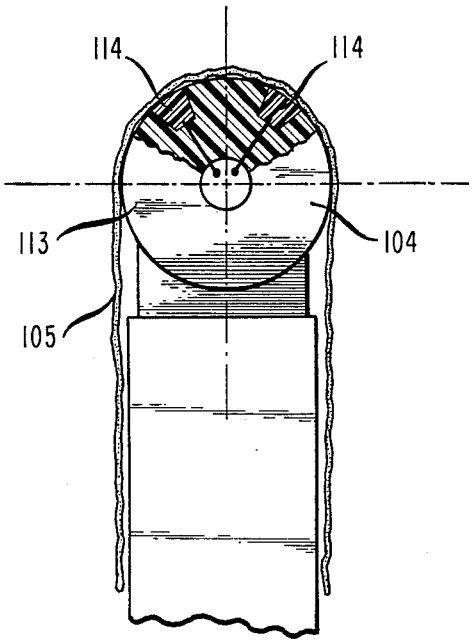
FIG. 11 is a view of a partial vertical section of a support for material to be treated with a humidity sensor.

The formation of the leather support region of a support 104 is shown in larger scale in FIG. 11. Because it continuously touches a leather piece 105, the rod shaped support part 113 is advantageously comprised of a material with relatively low absorption of microwaves. For this purpose known plastic materials are available in a large selection. The absorption capacity is furthermore advantageously selected such that it lies in the region of the of the desired leather quality under consideration of the presence of moisture. Thus since a certain electrical conductivity is permissible or can even be desired in the area of the leather support, there is also the possibility of providing humidity measuring sensors in the region of the leather support that are in continuous contact with the leather as long as the measurement electrodes 114 are produced from a plastic material or the like of suitable electrical conductivity. Therefore in this context a moisture content determination according to the in principle known method of determining the electrical conductivity of the material to be dried is a precondition in this instance. Great technical advantages result from the continuous measurement of moisture content with respect to measurement and control technique, and this is thus also possible for microwave radiation. Furthermore, a simplification of the arrangement of the measurement sensors is possible with respect to its construction.

The sealing or, respectively, shielding of outwardly penetrating leakage fields has great importance in the case of treatment chambers with microwave application. For this purpose, the feed opening 101 is provided with a tube seal 115 running along the opening edge as shown in FIG. 9. The inner space of the tube seal 115 is provided with a highly absorbing medium, which is preferably fluid and more preferably a liquid of corresponding conductivity. Such a microwave sealing is characterized by a high effectiveness with a simultaneously simple and strong construction. Furthermore, a high deformability and thus adaptibility versus large mass deviations between the parts to sealed against each other is a characteristic of this sealing. A further important property of these microwaves seals according to the invention is the warming and expansion of the medium or, respectively, of the liquid in case of large leaks occurring in the mechanical shielding elements usually predisposed relative to the microwave space. Such problem elements could be the edges of doors, door folding, rabbets and the like. The extension of and the pressure increase in the sealing tube effects in fact an increased pressing and penetration into the abnormally enlarged presealing slot, which represents a very desirable emergency sealing property.

Furthermore the expansion of the absorption medium in the envelope element, in particular in a tube, can result in a sealing and also in a detection of an abnormally large increase of the microwave energy present, where the sealing element assumes in addition a sensor function. The expansion of the contents can be comfortably detected via a suitable measurement or surveillance signal provided by a convention pressure sensor.

The example shows a uniformly acting microwave leak detector 116 with a liquid filled tube as a determined further embodiment of this step. The liquid filled tube extends like a frame over the two wings 103 of the door 102 and is connected with two expansion detectors 117, one for each door wing.

It will be understood that each of the elements described above, or two or more together, may also find a useful application in other types of drying and moisturizing system configurations and of flexible material processing procedures differing from the types described above.

While the invention has been illustrated and described as embodied in the context of a system for the conditioning of leather hides, etc., it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method for thermal treatment for animal skin products comprising subjecting an animal skin product to a pressure below atmospheric pressure;

applying an electromagnetic alternating wave field of a frequency from about 0.3 GHz to 30 GHz to the animal skin product in order to dry the animal skin product; moving the animal skin product through the electromagnetic alternating field in a lateral direction; contacting the animal skin product with a moisture sensor for determining the moisture content; and wherein the measurement sensor touches the leather during the sensing of the moisture.

2. The method for thermal treatment for animal skin products according to claim 1 wherein the animal skin product is a member of the group consisting of leather, hide, fur and composites thereof;

wherein the pressure below atmospheric pressure is below 0.7 bar; and wherein the value of the pressure below atmospheric pressure corresponds to a temperature of the evaporation point of the water contained in the animal skin product of up to about 70 degrees centigrade.

3. The method for thermal treatment for animal skin products according to claim 1 wherein the animal skin product is a member of the group consisting of leather, hide, fur and composites thereof;

wherein the pressure below atmospheric pressure is below 0.5 bar; and wherein the value of the pressure below atmospheric pressure corresponds to a temperature of the boiling point of water at the respective temperature for evaporating the water contained in the animal skin product of up to about 50 degrees centigrade.

4. The method for thermal treatment for animal skin products according to claim 1 wherein the animal skin product is subjected to electromagnetic waves of a frequency region of from about 1.2 to 2.8 GHz.

5. The method for thermal treatment for animal skin products according to claim 1 wherein the animal skin product is subjected to electromagnetic waves of a frequency region of from about 18 to 30 GHz.

6. The method for thermal treatment for animal skin products according to claim 1 wherein the subjection to below atmospheric pressure alternates with applying an electromagnetic wave field.

7. The method for thermal treatment for animal skin products according to claim 1 wherein the subjection to below atmospheric pressure occurs simultaneously with applying an electromagnetic wave field.

8. The method for thermal treatment for animal skin products according to claim 1 further comprising applying water in fluid form to the animal skin product.

9. The method for thermal treatment for animal skin products according to claim 1 further comprising applying water in fluid form and distributed relative to the animal skin product in conjunction with the thermal treatment.

10. The method for thermal treatment for animal skin products according to claim 1 further comprising determining an actual value for a moisture content of the animal skin product;

comparing the determined actual value with a preset set point value; and interrupting the application of the electromagnetic alternating wave field depending upon a reaching of the set point value by the determined actual value.

11. The method for thermal treatment for animal skin products according to claim 10 further comprising employing an electromagnetic alternating wave field of a frequency of from about 0.3 to 30 GHz;

intermittingly determining the actual value of the moisture content of the animal skin product.

12. The method for thermal treatment for animal skin products according to claim 10 further comprising employing a plurality of measurement sensors distributed over a piece of animal skin product for determining an actual value of a moisture content of the animal skin product.

13. The method for thermal treatment for animal skin products according to claim 12 further comprising performing a statistical value determination of the actual moisture content values associated with the different measurement locations.

14. An apparatus for thermal treatment of animal skin products comprising at least one treatment chamber for receiving and operating on animal skin products;

an electrical microwave heating device disposed at the chamber for permitting to heat animal skin products placed in the chamber, where the electrical microwave device generates an inhomogeneous electromagnetic field in the chamber and which inhomogeneous electromagnetic field in turn generates an inhomogeneous temperature field in the chamber;

a support movable in a lateral direction for an animal skin product to be supported by the movable support such that at least part of the inhomogeneous electromagnetic field is covered by a path of the animal skin product supported by the movable support;

a measurement sensor for contacting the animal skin product and for determining moisture content of the animal skin product;

where the measurement sensor touches the leather during the drying process for determining the moisture content of the leather; and a drive for the movable support connected to the movable support.

15. The apparatus for thermal treatment of animal skin products according to claim 14 wherein the electromagnetic heating device is subdivided into sections and further comprising a control device connected to the sections of the electromagnetic microwave heating device for activating sequentially various sections of the electromagnetic heating device.

16. The apparatus for thermal treatment of animal skin products according to claim 15 wherein the electromagnetic heating device comprises spacially distributedly placed microwave generators and where the microwave generators are activated according to a predetermined sequence.

17. The apparatus for thermal treatment of animal skin products according to claim 15 wherein the electromagnetic heating device comprises spacially distributedly placed and controllable microwave coupling devices and where the microwave coupling devices are activated according to a predetermined sequence.

18. The apparatus for thermal treatment of animal skin products according to claim 14 further comprising feed means for animal skin products in the wall of the chamber, wherein the electromagnetic heating device generates an energy field in the chamber and where an entry coupling direction of the microwave field is oriented substantially crosswise to a feed direction of the animal skin product.

19. The apparatus for thermal treatment of animal skin products according to claim 14 further comprising a grid disposition of microwave feeding devices in a wall of the chamber for generating an energy field with a predetermined maximum inhomogeneity in the treatment chamber.

20. The apparatus for thermal treatment of animal skin products according to claim 19 wherein the grid includes a disposition of multiple corner grid elements with a microwave feeding device disposed in the region of a corner.

21. The apparatus for thermal treatment of animal skin products according to claim 20 wherein the microwave feeding devices disposed at corners of grid elements are modulated with a phase shift corresponding about to their geometrical angle at the circumference of the multiple corner grid elements.

22. The apparatus for thermal treatment of animal skin products according to claim 14 wherein the electromagnetic microwave device includes a plurality of microwave power feeding devices in a wall of the chamber, where the microwave power feeding devices are disposed with their radiation output ports substantially immediately at a chamber wall bordering the treatment chamber.

23. The apparatus for thermal treatment of animal skin products according to claim 14 wherein the measurement sensor for humidity is movable for being disposed alternatingly at a sensing location touching the leather and at a rest position located remote from the animal skin product.

24. The apparatus for thermal treatment of animal skin products according to claim 14 further comprising a multiple measurement sensing device for determining animal skin product moisture content with a plurality of sensors active over the surface of the animal skin product.

25. The apparatus for thermal treatment of animal skin products according to claim 14 further comprising a multiple measurement sensing device for determining animal skin product moisture content with a sensor adjustable in its position over the animal skin product for scanning over the surface of the animal skin product.

26. The apparatus for thermal treatment of animal skin products according to claim 14 further comprising a construction unit providing a support device movable out of its working position within a chamber forming the treatment space through a section of a wall of the chamber, which chamber is during working conditions substantially closed.

27. The apparatus for thermal treatment of animal skin products according to claim 26 wherein the support device includes a front wall, a side wall, and a floor section of the chamber wall formed as a support element of the support device.

28. The apparatus for thermal treatment of animal skin products according to claim 27 wherein the support device includes a support means disposed at the front wall and the side wall, which are formed as horizontal support elements for the animal skin product.

29. The apparatus for thermal treatment of animal skin products according to claim 27 wherein the support device includes drive works disposed at the floor section.

30. The apparatus for thermal treatment of animal skin products according to claim 27 wherein the support device is formed as a movable construction unit, which can be moved independently of the treatment chamber in an outward moved state relative to the treatment chamber.

31. The apparatus for thermal treatment of animal skin products according to claim 14 wherein the electromagnetic microwave heating device is furnished such as to generate an energy field in the treatment space, wherein a support device with support means for animal skin products is provided and where the support means are comprised at least in the region of their touch points with the animal skin product of a material low in absorption of microwave radiation.

32. The apparatus for thermal treatment of animal skin products according to claim 31 wherein the support means are provided with moisture content sensors in the area of supporting the animal skin product.

33. The apparatus for thermal treatment of animal skin products according to claim 14 wherein the electromagnetic microwave heating device is furnished for generating an energy field in the treatment space; further comprising a feed opening for the animal skin product; closure means for sealing substantially without gaps the feed opening in the treatment space against emission of microwave radiation and for preventing a gas exchange between the treatment chamber and the outside.

34. The apparatus for thermal treatment of animal skin products according to claim 33 wherein the closure means includes a tube shaped envelope unit with a filling of an absorbing fluid medium.

35. The apparatus for thermal treatment of animal skin products according to claim 14 wherein the electromagnetic microwave heating device is furnished for generating an energy field in the treatment space; further comprising a feed opening for the animal skin product;

closure means for sealing substantially without gaps the feed opening in the treatment space against emission of microwave radiation and for preventing a gas exchange between the treatment chamber and the outside; and a substantially gapless detection unit for detecting an output of microwave radiation.

36. A method for thermal treatment for animal skin products comprising subjecting an animal skin product to a pressure below atmospheric pressure; and applying an electromagnetic alternating wave field of a frequency from about 0.3 GHz to 30 GHz to the animal skin product in order to dry the animal skin product wherein the subjection to below atmospheric pressure alternates with applying an electromagnetic wave field.

37. An apparatus for thermal treatment of animal skin products comprising at least one treatment chamber for receiving and operating on animal skin products;

an electrical microwave heating device disposed at the chamber for permitting to heat animal skin products placed in the chamber, wherein the electromagnetic heating device is subdivided into sections and wherein the electrical microwave device generates an inhomogeneous electromagnetic field in the chamber and which inhomogeneous electromagnetic field in turn generates a inhomogeneous temperature field in the chamber;

a movable support for an animal skin product to be supported by the movable support such that at least part of the inhomogeneous electromagnetic field is covered by a path of the animal skin product supported by the movable support; a drive for the movable support connected to the movable support; and a control device connected to the sections of the electromagnetic microwave heating device for activating sequentially various sections of the electromagnetic heating device.

38. The apparatus for thermal treatment of animal skin products according to claim 37 wherein the electromagnetic heating device comprises spacially distributedly placed microwave generators and where the microwave generators are activated according to a predetermined sequence.

39. The apparatus for thermal treatment of animal skin products according to claim 37 wherein the electromagnetic heating device comprises spacially distributedly placed and controllable microwave coupling devices and where the microwave coupling devices are activated according to a predetermined sequence.

40. An apparatus for thermal treatment of animal skin products comprising at least one treatment chamber for receiving and operating on animal skin products;

an electrical microwave heating device disposed at the chamber for permitting to heat animal skin products placed in the chamber, where the electrical microwave device generates an inhomogeneous electromagnetic field in the chamber and which inhomogeneous electromagnetic field in turn generates an inhomogeneous temperature field in the chamber;

a movable support for an animal skin product to be supported by the movable support such that at least part of the inhomogeneous electromagnetic field is covered by a path of the animal skin product supported by the movable support; a drive for the movable support connected to the movable support; and a grid disposition of microwave feeding devices in a wall of the chamber for generating an energy field with a predetermined maximum inhomogeneity in the treatment chamber.

41. The apparatus for thermal treatment of animal skin products according to claim 40 wherein the grid includes a disposition of multiple corner grid elements with a microwave feeding device disposed in the region of a corner.

42. The apparatus for thermal treatment of animal skin products according to claim 41 wherein the microwave feeding devices disposed at corners of grid elements are modulated with a phase shift corresponding about to their geometrical angle at the circumference of the multiple corner grid elements.

43. An apparatus for thermal treatment of animal skin products comprising at least one treatment chamber for receiving and operating on animal skin products;

an electrical microwave heating device disposed at the chamber for permitting to heat animal skin products placed in the chamber, where the electrical microwave device generates an inhomogeneous electromagnetic field in the chamber and which inhomogeneous electromagnetic field in turn generates an inhomogeneous temperature field in the chamber;

a movable support for an animal product to be supported by the movable support such that at least part of the inhomogeneous electromagnetic field is covered by a path of the animal skin product supported by the movable support, wherein the movable support includes a front wall, a side wall, and a floor section of the chamber wall formed as a support element of the movable support;

a drive for the movable support connected to the movable support; and a construction unit providing a support device movable out of its working position within a chamber forming the treatment space through a section of a wall of the chamber, which chamber is during working conditions substantially closed.

44. The apparatus for thermal treatment of animal skin products according to claim 43 wherein the support device includes a support means disposed at the front wall and the side wall, which are formed as horizontal support elements for the animal skin product.

45. The apparatus for thermal treatment of animal skin products according to claim 43 wherein the support device includes drive works disposed at the floor section.

46. The apparatus for thermal treatment of animal skin products according to claim 43 wherein the support device is formed as a movable construction unit, which can be moved independently of the treatment chamber in an outward moved state relative to the treatment chamber.

47. An apparatus for thermal treatment of animal skin products comprising at least one treatment chamber for receiving and operating on animal skin products;

an electrical microwave heating device disposed at the chamber for permitting to heat animal skin products placed in the chamber, wherein the electromagnetic microwave heating device is furnished such as to generate an energy field in the treatment space, wherein a support device with support means for animal skin products is provided and where the support means are comprised at least in the region of their touch points with the animal skin product of a material low in absorption of microwave radiation and wherein the electrical microwave device generates an inhomogeneous electromagnetic field in the chamber and which inhomogeneous electromagnetic field in turn generates an inhomogeneous temperature field in the chamber;

a movable support for an animal skin product to be supported by the movable support such that at least part of the inhomogeneous electromagnetic field is covered by a path of the animal skin product supported by the movable support and wherein the movable support is provided with moisture content sensors in the area of supporting the animal skin product; and a drive for the movable support connected to the movable support.

* * * * *